United States Patent [19]

Rayner et al.

[11] 4,225,045

[45] Sep. 30, 1980

[54] CONTAINERS

[75] Inventors: Adrien P. Rayner, Iver; John D. Messenger, Swindon; James T. Green, Reading, all of England

[73] Assignee: Metal Box Limited, Reading, England

[21] Appl. No.: 962,621

[22] Filed: Nov. 21, 1978

[30] Foreign Application Priority Data

Nov. 28, 1977 [GB] United Kingdom ..... 49482/77

[51] Int. Cl.[2] ..... B65D 21/02; B65D 25/02; B65D 25/28; B65D 43/10

[52] U.S. Cl. ..... 206/508; 206/525; 220/90; 220/91; 220/94 R; 220/284; 220/306

[58] Field of Search ..... 220/90, 91, 95, 67, 220/72, 94 R, 285, 284, 306, 90.4, 83, 306; 15/257.075, 258, 259; 401/121, 122; 206/581, 229, 508, 525

[56] References Cited

U.S. PATENT DOCUMENTS

| | | | |
|---|---|---|---|
| 1,021,004 | 3/1912 | Sanford | 220/90 |
| 1,238,830 | 9/1917 | Schuster et al. | 220/90 X |
| 1,943,639 | 1/1934 | Thatcher | 220/90 X |
| 2,072,295 | 3/1937 | Courtney | 220/354 X |
| 2,174,618 | 10/1939 | Burdick | 206/581 |
| 3,015,120 | 1/1962 | Anderson | 206/229 X |
| 3,052,371 | 9/1962 | Van Bemmelen | 220/355 X |
| 3,117,873 | 1/1964 | Bartels et al. | 220/72 X |
| 3,288,340 | 11/1966 | Shapiro et al. | 206/519 X |
| 3,341,107 | 9/1967 | Poupitch | 220/91 X |
| 3,389,828 | 6/1968 | Godshald | 220/95 X |
| 3,405,439 | 10/1968 | Vemura | 220/67 X |
| 3,516,571 | 6/1970 | Roper et al. | 220/72 X |
| 3,520,441 | 7/1970 | Fitzgerald | 220/306 |
| 3,524,568 | 8/1970 | Nughes | 220/67 |
| 3,550,832 | 12/1970 | Fitzgerald | 220/67 X |
| 3,744,671 | 7/1973 | Saunders, Jr. | 220/90 |
| 3,930,280 | 1/1976 | Vasas | 401/122 X |

FOREIGN PATENT DOCUMENTS

| | | | |
|---|---|---|---|
| 147646 | 9/1951 | Australia | 220/90 |
| 1534050 | 7/1968 | France | 220/91 |
| 537260 | 6/1941 | United Kingdom | 220/67 |
| 722573 | 1/1955 | United Kingdom | 220/91 |
| 821893 | 10/1959 | United Kingdom | 220/91 |
| 1456008 | 11/1976 | United Kingdom . | |

*Primary Examiner*—Allan N. Shoap
*Attorney, Agent, or Firm*—Diller, Ramik & Wight

[57] ABSTRACT

There is disclosed a container for containing a liquid such as paint, the container having a side wall and a bottom moulded in one piece from plastics material, the container being formed to co-operate with and retain a removable lid, and comprising a flexible inwardly projecting flange moulded integrally with the side wall and adjacent the top thereof, the flange being upwardly and inwardly inclined at its attachment to the side wall. Because the flange is flexible and is inclined to the side wall at its point of attachment to the side wall, the core on which the container is moulded can be withdrawn from the container past the flange, as the flange will deflect and ride over the core. The flange then springs back to its inwardly projecting position and serves to prevent liquid slopping out of the container if the container is filled with liquid on a standard filling line such as is used for metal lever-ring paint containers.

9 Claims, 8 Drawing Figures

CONTAINERS

FIELD OF THE INVENTION

This invention relates to containers and especially containers suitable for use as paint pots or paint pails.

BACKGROUND OF THE INVENTION

It has been usual to package paint in built-up cans, either with or without a handle, having the top closed by a lever lid. Such cans require a substantial amount of fabrication and therefore are relatively expensive.

More recently, paint has to some extent been packaged in containers, which may be referred to as pots or pails, which are moulded from plastics material. This enables substantial reduction of the amount of fabrication required because the bottom and wall of the container can be moulded in a single piece, the lid being the only part which has to be manufactured and applied separately. However, in order to mould the container body in a single piece it has been necessary to leave the inner wall of the container substantially unobstructed so as to enable withdrawal of the mould core from the inside of the container upon completion of the moulding.

When containers are transported along a filling line, to be filled with paint, they are subjected to a certain amount of irregular movement so once the container is filled to a level close to its top there is a tendency for paint to be spilled or slopped over the edge of the container. This is not a significant problem in the usual built-up cans with a lever ring, because the inwardly projecting lever ring tends to prevent paint slopping over the edge of the can. It is, however, a substantial problem when plastic containers are used and attempts to solve it have involved either modifying the filling lines so as to produce less irregular movement of the container, or to employ an over-sized container which will not need to be filled so close to its top, but which of course involves waste because the container has to be made larger than is really necessary to contain the desired amount of paint.

SUMMARY OF THE INVENTION

In accordance with the present invention there is provided a container having a side wall and a bottom moulded in one piece from plastics material, and a flexible inwardly projecting flange moulded integrally with the side wall adjacent the top thereof.

We have found that the provision of such a flexible inwardly projecting flange near the top of the container enables spilling by slopping to be avoided substantially to the same extent as it is avoided by a lever ring of the traditional can, so that the container can be used on existing can filling lines without them having to be modified. At the same time, the container can be moulded in one piece because the flexibility of the inwardly projecting flange enables the flange to slip over the mould core as the core is withdrawn from the inside of the container on completion of moulding.

In order to further facilitate this, the flange preferably comprises a plurality of flange portions flexible at least partly independently of each other. Each flange portion can then, at least partly, bend back separately as the mould core is withdrawn and hence not as much stretching of the flange material is required as would be the case if the flange is a complete unbroken ring.

Preferably the flange is angled towards the top of the container and preferably also a channel is defined between the flange and the top marginal portion of the container wall and the flange has apertures therein for draining the channel.

In this way, if any paint goes over the top of the flange, for example due to irregular movement of the container when it is being filled, or when a user of the paint employs the flange to remove excess paint from his brush (which is a secondary but very useful function of the flange), it will initially run into the channel but will not remain there because it can escape back into the body of the container through the apertures.

Although it is possible for such drainage apertures, and slits or slots which divide the flange into independent portions, to be provided independently of each other, in the preferred embodiment the drainage apertures divide the flange into flange portions flexible independently of each other, hence serving both these purposes. A container in accordance with the invention may be provided with handle mounting facilities moulded integrally with the container wall, and some preferred forms of such facilities will be described below.

Preferably the container has a downwardly facing shoulder or shoulders moulded on the outside of the wall adjacent its top, and a lid provided with an inwardly shouldered rim for fitting over the container top and retention by said shouldered rim engaging over said shoulder or shoulders.

Then, the lid preferably has an annular recess around the periphery of its inner side adapted to engage both the inside and the outside of the top margin of the container wall when the lid is fitted on the container.

Engagement of this recess with the inside of the can wall at its top edge, as well as with the outside of the can wall, tends to make the top of the lidded can more rigid and therefore better resists deformation which could otherwise encourage the engaging external shoulders to become disengaged so that the lid could come off the container.

A further preferred feature is that the container may have a rib round the outside of its wall positioned to lie just below the rim of said lid, when fitted, and of a size sufficient to protect the rim from being caught by other articles.

This minimizes the possibility of the lid being accidentally pulled up and released by something catching under the edge of its rim when the container is being handled, or when something adjacent the container is being moved.

Any lid with which the container may be provided will preferably have a recess in its outer side dimensioned to locate the bottom of a similar container when two or more containers are stacked.

Also, it is preferred for the side wall of the container to be substantially perpendicular to its bottom.

Both these features facilitate secure and firm stacking of such containers one on top of the other.

In order that the invention may be more clearly understood some embodiments thereof will now be described, by way of example, with reference to the accompanying diagrammatic drawings.

DETAILED DESCRIPTION OF EMBODIMENTS

Figure 1:
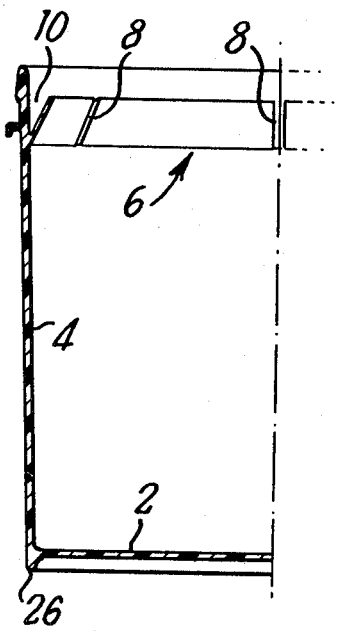
FIG. 1 shows in cross-section half of a container in accordance with the invention. It is unnecessary to show the complete container because it is cylindrical and symmetrical about the central axis.

The container shown in FIG. 1 is moulded in one piece from a suitable plastics material such as polypropylene and comprises a bottom 2 and a cylindrical side wall 4. From the inside of the side wall 4, adjacent its top, projects a flange generally indicated at 6. The exact angle of the flange 6 is not crucial but in one example the angle between the flange and the side wall is approximately 30° . The flange 6 should be of a construction and thickness which enables it to be flexible so that an internal core used in moulding the container can deform it without significantly damaging it as the core is withdrawn from the container after moulding. In one example, to provide this degree of flexibility, the flange is divided into six equal flange portions by means of equally spaced slots 8 of which only two can be seen in FIG. 1, and the thickness of the flange is approximately 0.5 mm.

When a container as shown in FIG. 1 is filled with paint on a standard filling line as used for leverring cans, it can be filled to just below the flange 6 without the risk of paint slopping over the top of the can as the can subsequently moves along the filling lane to the lidding station, because the flange acts as a baffle which resists such slopping. It should be noted that a channel 10 is formed between the flange 6 and the top marginal portion of the wall 4 and any paint which may slop over the top of the flange will run into this channel, from where it can run back into the body of the container through the slots 8. To enable such drainage to be complete, the slots 8 preferably extend completely to the base of the flange 6, though for the purpose of adequate flexibility it is not absolutely essential that the slots extend that far. If the slots are not extended that far, then additional drainage apertures may be provided where the flange meets the container wall 4.

Figure 2:
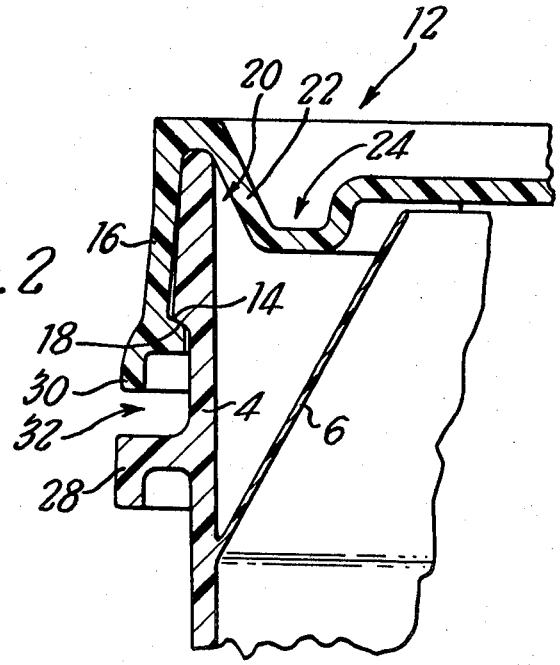
FIG. 2 shows on a larger scale the top part of the wall of the container of FIG. 1, and how it may be fitted with a preferred form of lid.

FIG. 2 shows in more detail the top part of the container wall of FIG. 1, and in addition shows how a particular form of lid 12 may be provided to fit over the top of the container. Only a portion of the lid 12 is shown because the lid is circular and symmetrical about its central axis.

An annular downwardly facing shoulder 14 is moulded on the outside of the wall 4 adjacent its top, and the lid 12 is provided with a downwardly extending annular rim 16 having an inwardly projecting annular shoulder 18 so that the lid may be pushed down over the top of the container and the lid shoulder 18 will snap in behind the external wall shoulder 14 to securely hold the lid in place. Secure retention of the lid is assisted by the provision of an annular recess 20 around the periphery of the lid on its inner side, the recess being dimensioned so that it engages both the inside and outside of the container wall 4, at least near the upper edge of the container wall, and this construction helps prevent the possibility of the shoulders 14 and 18 being brought out of engagement by deformation either of the lid or the wall 4.

A lid portion 22 which forms the inner wall of the recess 20, also forms the outer wall of an annular recess 24 on the outside of the lid 12. This recess 24 preferably has the same diameter as that of the projecting flange 26 (see FIG. 1) formed by the lowest part of wall 4, so that one container can be stood on top of another with the flange 26 of the upper one fitting securely into the recess 24 in the lid of the lower one, thus facilitating secure and easy stacking. In order to achieve this relationship between the lid and the flange 26 the flange 26 may be located slightly inboard of the wall 4, or alternatively the wall 4 may flare slightly outwardly towards its top, typically at an angle of between 1° and 2° relative to the central axis of the container. Nevertheless, preferably the wall 4 is substantially, though not necessarily exactly, perpendicular to the bottom 2 so that the containers have substantial vertical rigidity for resisting the weight on the lowest container when they are stacked.

There is also a rib 28, which may be of the shape shown in FIG. 2, moulded integrally with the outside of the wall 4 and preferably projecting radially as far as, or a little further than, the lower edge 30 of the lid rim 16. This prevents the edge 30 of the rim 16 from being caught by other articles so as to reduce the chance of the lid being pulled or knocked off accidentally. However, it facilitates deliberate removal of the lid by providing a recess 32 between the lower edge of the lid and the rib 28 into which a coin, screwdriver tip, or other suitable instrument may be inserted to lever the lid free of the shoulder 14 to open the container.

A pair of handle mounting facilities may be integrally moulded on the outside of the wall 4 of the container at diametrically opposed positions, and fairly close to the top of the container, thus enabling a generally U-shaped or flexible handle to be provided, extending from one of these mountings to the other so that the can can be easily carried, and held during use.

Figure 3:
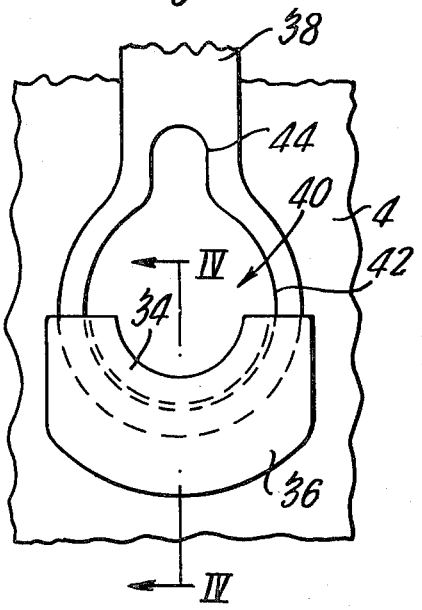
FIG. 3 shows a side elevation of one form of handle mounting.
Figure 4:
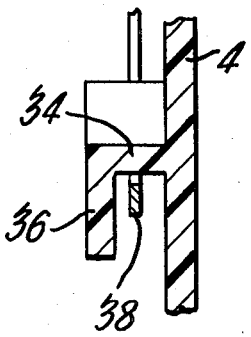
FIG. 4 shows a cross-section on the line IV—IV of FIG. 3.

One such form of handle mounting is shown in FIGS. 3 and 4. It comprises a semi-cylindrical wall portion 34 extending perpendicular to the wall 4, at the outer end of which is an approximately semiannular flange 36 directed downwardly relative to the body of the container. Various types of handle may be secured between a pair of mountings of this kind, but a preferred handle 38 is in the form of a strap made of plastics or other suitable material and having at each of its ends an aperture 40 having a peripheral portion 42 which is at least partly circular with a diameter approximating to the outer diameter of semi-circular wall 34, and having an extension 44 which enables the aperture to be easily deformed to fit over the flange 36 so as to come into the position shown in FIGS. 3 and 4. Such a handle 38 will be symmetrical about its middle so only one end has been shown in FIGS. 3 and 4.

Figure 5:
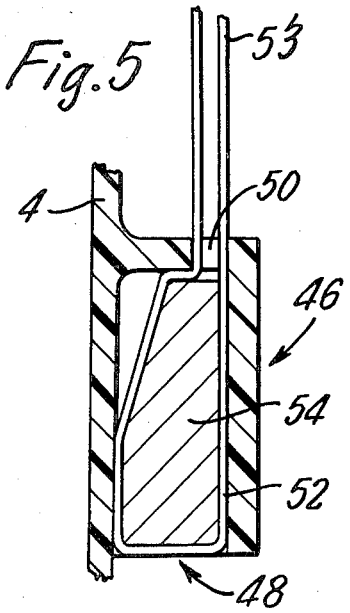
FIG. 5 shows an alternative form of handle mounting in vertical cross-section.
Figure 6:
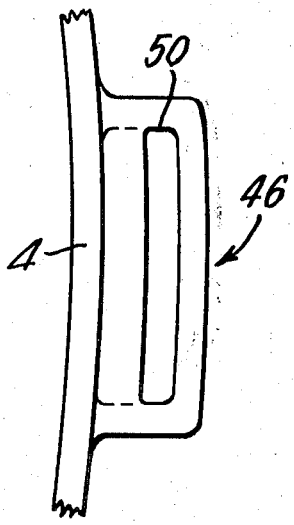
FIG. 6 shows the handle mounting of FIG. 5 when viewed from above.

FIGS. 5 and 6 show an alternative type of integral moulded handle mounting which is generally in the form of a box 46 moulded onto the outside of wall 4 and being open at its bottom 48 and having a slot 50 in its top. A handle consisting of a suitable length of flexible material is secured at each end to a pair of these mountings in the following way. A bight 52 of the flexible material 53 is formed, near the end of the length, and is passed downwards through the slot 50 until it projects through the open bottom 48 of the box 46. A generally wedge-shaped member 54 is then positioned in the bight 52 and the bight is pulled up into the box 46, thus taking the member 54 with it and causing the bight to be wedged between the member 54 and the walls of the box 46 which lie to either side of it, as illustrated in FIG. 5.

It should be mentioned that the lid 12 described above is preferably made of plastics material such as polypropylene but may alternatively be made to a comparable design in metal if desired.

Modified forms of moulded plastics containers, intended primarily for paint, are also envisaged which have a cylindrical plastics wall and which can also make use of the handle mountings illustrated in FIGS. 3 to 6.

A first form of such container comprises a body having an integrally moulded bottom and side wall approximately as shown in FIG. 1 but without the external shoulder and rib and without the internal flange 6. It thus has a plain top edge. A conventional metal lever ring is then secured to this top edge in any suitable known manner, for example, by doubleseaming. Such a container can naturally be filled on a conventional filling line as used for lever ring metal cans, without slopping, and then can be sealed by the usual lever lid, made either of plastics or metal.

In a further form, a lever ring of conventional basic form is moulded in plastics material integral with the top edge of the container body. Owing to the requirement to withdraw the mould core, this requires the body to be moulded without a bottom. The bottom of the container body is then closed either by application of a metal (e.g. tin plate) bottom for example by conventional double seaming, or by fixing on a plastic bottom for example by spin welding or by adhesive. Again, because of the moulded-on lever ring such a can can be filled on a conventional filling line without slopping.

A lid for the latter form of container may again be either a metal or moulded plastics lever-type lid.

Figure 7:
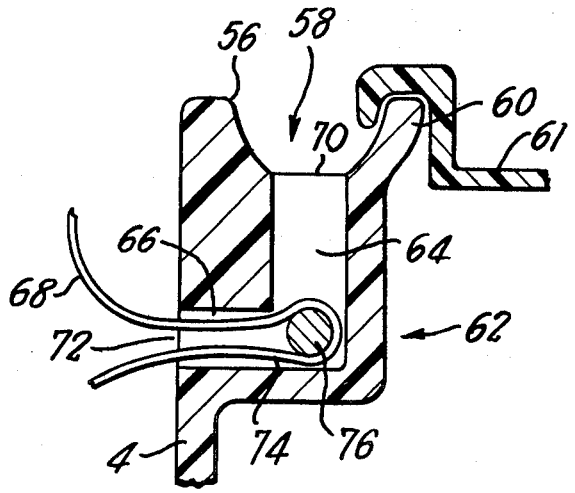
FIG. 7 shows another type of integral handle mounting.

FIG. 7 shows a form of handle mounting particularly suited to the type of container which has just been described. The upper part of the wall of the container is shown at 4, with the inwardly projecting integrally moulded lever ring being shown as comprising an outer rim 56, the usual channel 58, and an inwardly projecting inner rim portion 60, which of course will extend right round the aperture in the lever ring and will receive the plug part of a lever lid 61.

Moulded integrally with the wall 4 is a "box" 62 which has moulded therein a generally L-shaped slot having an upper arm 64 which is wider than its lower arm 66. The slot will have a dimension (perpendicular to the plane of the drawing) somewhat greater than the width of a strap of flexible material 68 intended to form a handle for the container. The upper arm 64 of the slot opens into the recess 58 at a slit 70 and the lower arm 66 opens to the outside of the wall 4 at a slit 72. To secure each end of a strap handle to a respective one of an opposed pair of these mountings a bight 74 is pushed in through the slit 72 and through the slot until it emerges through the upper slit 70. A short rod or other suitable member 76 of plastics or other material is then inserted into the bight, which is then pulled back into the slot. It can pass downwards through arm 64 of the slot but when it reaches the narrower part of the slot, for example the narrow lower arm 66, the member 76 and the bight 74 together become wedged thus securing the end of the strap 68 against being pulled out of the mounting.

Figure 8:
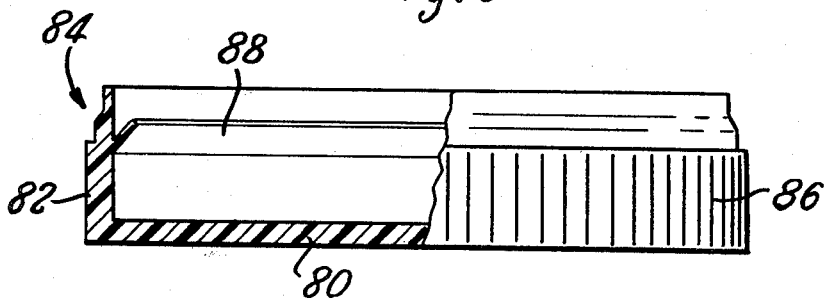
FIG. 8 shows a partial cross-section of a further container in accordance with the invention.

FIG. 8 shows a further embodiment of the invention, being a one-piece moulded plastics container which is substantially less deep than it is wide. The container is shown from the side, partly in cross-section. It has a bottom 80 and a side wall 82, the upper portion 84 of the side wall 82 being formed to accept a friction-fit lid and the outside of the lower portion of wall 82 being knurled as indicated at 86 to facilitate firmly gripping the container to remove the lid. The container is intended to contain a product of the kind which is filled into the container as a liquid but which solidifies in the container at room temperature, such as a polish, which is filled in a hot liquid state.

The container is provided with an integral internal formation in the form of a flange 88, which is shown as a continuous annular flange but which may have any of the features of the flange 6 described above, including the feature of being split into separate flange portions. In use, the container is filled with the liquid product to above the level of the flange 88 and preferably right to the rim of the container. When the product solidifies, the flange extending into the solidified product holds it in the container even though the solidified product may shrink with ageing and drying out.

It should be appreciated that the container may be adapted to receive a lid different from the pushon friction-fit lid referred to above.

It will be appreciated that the form and flexibility of the flange 88 enable the mould core used when moulding the container to be withdrawn outwardly past the flange, temporarily deforming the flange in the process, as is the case with the flange in the previous embodiment.

It should be understood from the foregoing that, in both embodiments, it is the inclination of the flange in the region where it joins the side wall that is significant in facilitating release of the container from the mould. The shape of the portion of the flange towards its free edge can be varied substantially without hindering release from the mould, so that the flange need not be straight, in transverse cross-section as in the examples shown.

We claim:

1. An anti-slop container for liquids, having a side wall and a bottom moulded in one piece from plastics material, the container being formed to co-operate with and retain a replaceable lid, and comprising a flange moulded integrally with the side wall and adjacent the top thereof, said flange being of single thickness, projecting inwardly to a free edge, and extending substantially entirely around the side wall, at its attachment to the side wall the flange being upwardly and inwardly inclined, the flange being substantially thinner than the side wall and being formed with slots which divide the flange into portions flexible independently of each other, whereby all said portions are simultaneously flexible outwardly towards the container wall and upwardly towards the top of the container.

2. A container as claimed in claim 1 having a downwardly facing shoulder moulded on the outside of the wall adjacent its top, and a lid provided with an inwardly shouldered rim for fitting over the container top and retention by said shouldered rim engaging over said shoulder, the lid has an annular recess around the periphery of its inner side adapted to engage both the inside and the outside of the top margin of the container wall when the lid is fitted on the container.

3. A container as claimed in claim 1 having a downwardly facing shoulder moulded on the outside of the wall adjacent its top, and a lid provided with an inwardly shouldered rim for fitting over the container top and retention by said shouldered rim engaging over said shoulder, the container has a rib round the outside of its wall positioned to lie just below the rim of said lid, when fitted, and of a size sufficient to protect the rim from being caught by other articles.

4. A container as claimed in claim 1, provided with a lid, and wherein the lid has a recess in its outer side dimensioned to locate the bottom of a similar container when two or more containers are stacked.

5. A container as claimed in claim 1, wherein the side wall of the container is substantially perpendicular to its bottom.

6. A container as claimed in claim 1, provided with handle mounting facilities moulded integrally with the container wall.

7. A container as claimed in claim 6, wherein said handle mounting facilities comprise lugs on opposite sides of the container, each lug comprising a downwardly convex part -cylindrical portion projecting outwardly from the container wall, and a flange projecting radially outwardly from the outer end of said part cylindrical portion.

8. A container as claimed in claim 6, wherein said handle mounting facilities comprise box-like structures on opposite sides of the container, each box-like structure having an opening at its bottom and at its top, and a wedging member adapted to fit relatively closely into each structure through the bottom opening, but not pass through the top opening.

9. A container as claimed in claim 1 containing a liquid material up to a level not above the flange, having a downwardly facing shoulder moulded on the outside of the wall adjacent its top, and a lid provided with an inwardly shouldered rim, said lid being fitted over the container top and retained by said shouldered rim engaging over said shoulder.

* * * * *